United States Patent [19]

Hamilton

[11] Patent Number: 4,746,090

[45] Date of Patent: May 24, 1988

[54] HAIR DRYER HOLDER

[76] Inventor: Ronald L. Hamilton, 9343 Comstock Dr., Cincinnati, Ohio 45231

[21] Appl. No.: 57

[22] Filed: Jan. 2, 1987

[51] Int. Cl.[4] ..... A47F 5/00

[52] U.S. Cl. ..... 248/314

[58] Field of Search ..... 248/70, 103, 125, 219.3, 248/222.4, 309.1, 312, 312.1, 315, 316.7, 314, 297.3, 73; 211/70.6, 208; 403/253, 254, 255; 219/242

[56] References Cited

U.S. PATENT DOCUMENTS

| | | | |
|---|---|---|---|
| 44,447 | 9/1864 | O'Donnell | 248/315 |
| 874,014 | 12/1907 | Kurtzon | 248/222.4 |
| 3,540,687 | 11/1970 | Cuva | 248/223.4 |
| 4,136,848 | 1/1979 | McCollum | 248/316.7 |
| 4,219,178 | 8/1980 | Assion | 248/314 |
| 4,225,106 | 9/1980 | Eplan | 248/314 |
| 4,278,223 | 7/1981 | Fauteux | 248/125 |
| 4,466,203 | 8/1984 | Thomas | 248/125 |

FOREIGN PATENT DOCUMENTS

| | | | |
|---|---|---|---|
| 331733 | 7/1958 | Switzerland | 248/222.4 |
| 605669 | 7/1948 | United Kingdom | 248/73 |
| 1601824 | 11/1981 | United Kingdom | 248/73 |

*Primary Examiner*—J. Franklin Foss
*Assistant Examiner*—Robert A. Olson
*Attorney, Agent, or Firm*—Charles R. Wilson

[57] ABSTRACT

An adjustable holder device for a hand held hair dryer allows rotational and vertical movement of the hair dryer according to the needs of the user. The device comprises a holder member having an open-sided receiving hole in one extremity dimensioned to receive a handle of a hair dryer and attachment means on another extremity. A wall mount base is also provided which is capable of being permanently attached to a wall with complimentary means for receiving the attachment means of the holder member in varying vertical positions.

3 Claims, 2 Drawing Sheets

HAIR DRYER HOLDER

This invention relates to a holder for hair dryers. More particularly, the invention relates to a holder for hair dryers which permits rotational and vertical movement of the dryer during use.

BACKGROUND OF THE INVENTION

Hand held hair dryers for use in the home are well known. Typically, they have an elongated handle for easy grasping. The user of the hair dryer will hold the hair dryer in one hand and direct hot air from a barrel onto the hair. A second hand is free to comb or brush the hair. It is not possible for one person to style his hair with both hands while drying his hair. Additionally, it is not possible for a person who does not have full use of his hands or arms because of some disability to fully use the conventional hair dryer.

Various attempts have been made in the prior art to devise a holder or stand for use in the home with electric hair dryers. For example, U.S. Pat. No. 4,219,178 discloses a holder device for a electric hair dryer. The holder device is mounted on the wall. The hair dryer once properly positioned is capable of moving in a rotational fashion in the holder. U.S. Pat. No. 4,225,106 is similar in that a holder device is constructed for permanent attachment to a wall. The disclosed device permits substantial lateral movement of a hair held dryer. However, the devices of the aforesaid patents do not permit vertical movement of the hair dryer. As a result the hair dryer must be mounted to the wall in a fixed location which is at best convenient for one user, but not necessarily for another user in the same family.

There is a need for a holder device for hair dryers which is more flexible in its use. Ideally, the device would allow movement of the hair dryer in a vertical direction as well as in lateral directions. There has now been discovered a holder device which fulfills a long felt need of the prior art. The device is economical and can be readily installed in a home.

SUMMARY OF THE INVENTION

An adjustible holder device for a hand held hair dryer permits rotational and vertical movement of the hair dryer according to the needs of the user. The device comprises a holder member and a wall mount base. The holder member has an open-sided receiving slot in one extremity dimensioned to receive a handle of a hair dryer and attachment means in another extremity. The slot is dimensioned such that the hair dryer is free to move rotationally. The wall mount base is capable of being permanently attached to a wall. The wall mount base additionally has complimentary receiving means on a front section to receive the attachment means of the holder member. The complimentary receiving means are capable of receiving and securing the holder member in varying vertical positions.

DETAILED DESCRIPTION OF THE INVENTION

Figure 1:
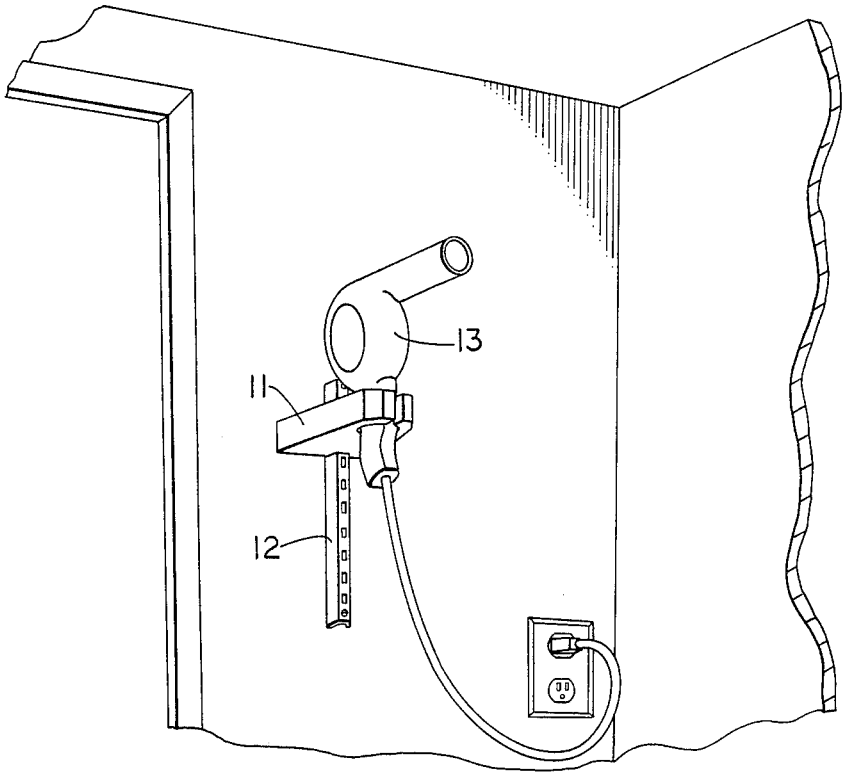
FIG. 1 is a view in perspective of the holder device on this invention when mounted on a wall.

Referring now to the drawings for a more detailed description of the present invention, the holder device of this invention comprises a holder member and a wall mount base. Each of the elements as well as a mode of operation are described in the following paragraphs.

As shown in FIG.1 the holder device of this invention comprises a holder member 11 and a wall mount base 12. A typical hair dryer 13 is shown. The casing comprises an electric motor, fan and a heating unit. Heated air is generated and blown through a barrel and out a discharge orifice. An elongated handle is provided for easy grasping. An electric cord extends from the handle to an electrical outlet.

The holder member 11 comprises a body 14 with a receiving hole 15 in one extremity and attachment means 16 on a second extremity. The holder member body is variously shaped and made of any suitable material. As shown, the holder member is generally block shaped. Any other suitable shaped member body capable of having a receiving hole and attachment means can be used. A premolded rigid plastic material is preferably used in constructing the holder member body.

Figure 3:
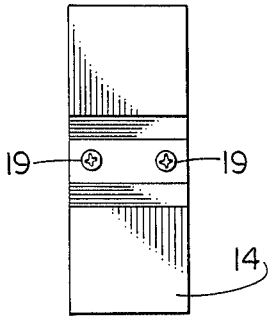
FIG. 3 is a back view of the holder member of FIG. 1.
Figure 2:
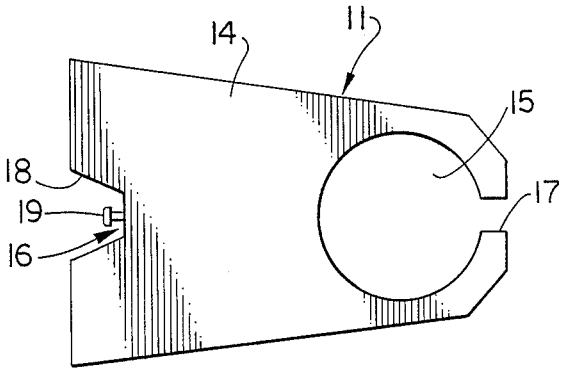
FIG. 2 is a top view of the holder member of FIG. 1.
Figure 4:
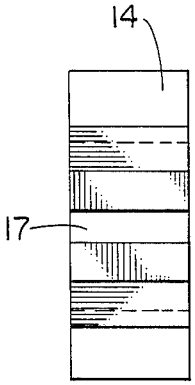
FIG. 4 is a front view of the holder member of FIG. 1
Figure 5:
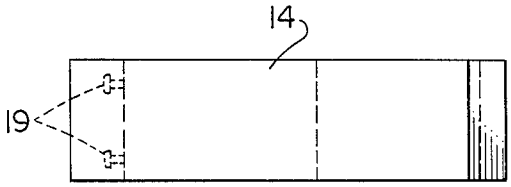
FIG. 5 is a side view of the holder member of FIG. 1

As shown, the receiving hole 15 is circular and is open-sided. Typically, handles of hair dryers are cylindrical in nature. Accordingly, the receiving hole is cylindrical to conform to the handle. The receiving hole 15 is open-sided so as to allow the handle with its electric cord to pass readily into the receiving slot. Slot 17 is sufficiently wide to allow an electric cord to pass therethrough. Other shaped holes can be used depending upon the particular hair dryer handle the hole is to accomodate. Another extremity of the holder member comprises attachment means 16. Preferably, the holder device has a recess 18 in the back side to accomodate the wall mount base. The attachment means are positioned in the deepest portion of the recess 18. When attached to the wall mount base, the holder device is flush with the wall on which the wall mount base has been permanently attached. As best shown in FIGS. 2 and 3 the attachment means are protrusions which extend from the back side. Such protrusions 19 with their knobbed heads extend from the holder member a sufficient distance to fit into the complimentary receiving means on the wall base mount as described below.

Figure 6:
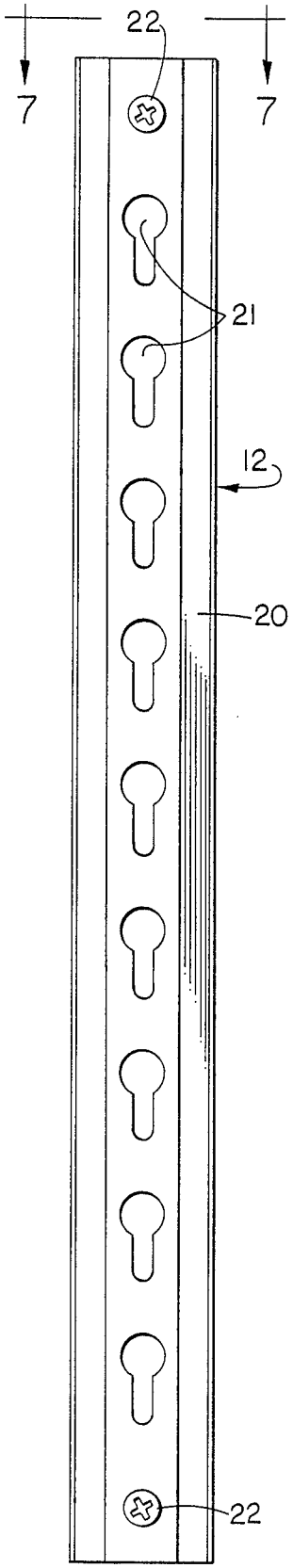
FIG. 6 is a front view of the wall mount base of FIG. 1.
Figure 7:
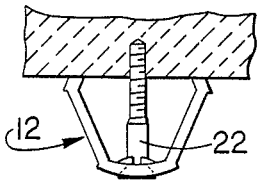
FIG. 7 is a top view of the wall mount base of FIG. 6

A wall mount base 12 is also provided for use with the holder member. With reference to FIGS. 6 AND 7, it is dimensioned to compliment the holder member both in functionality and appearance. The base generally has a flat surface to fit tightly against a wall and has an elongated body 20 to permit placement of a series of complimentary receiving means 21. Typically, the wall mount base ranges from about 6 inches to about 20 inches, preferably about 10 inches to 15 inches in length. The wall mount base is intended for permanent mounting on a wall. Conventional attachment means such as screws 22 or double sided adhesive tapes are used for this purpose.

Complimentary receiving means 21 are positioned along the length of the wall mount base's front section to receive the protrusions of the holder member. A series of keyhole shaped openings are depicted running lengthwise along the base's front section. The protrusions 19 of the holder member can be mounted in any of the openings thereby allowing a user of the device to choose a particular height which best fits his needs.

FIG. 1 illustrates the holder device of this invention when permanently mounted on a wall. The handle of the hair dryer is shown positioned within the receiving hole 15. Proper dimensioning of the receiving hole allows the handle of the hair dryer to revolve freely. The lengthwise positioning of the keyhole shaped openings 23 allows the holder member to be positioned at varying heights along the wall.

Figure 8:
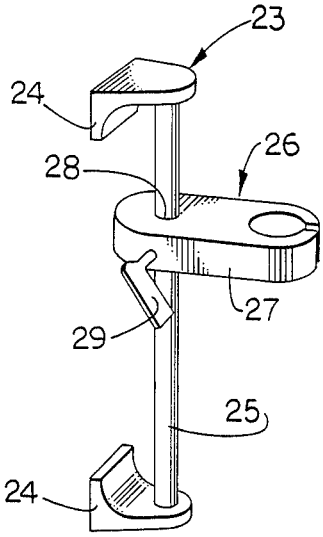
FIG. 8 is a view in perspective of an alternative holder device with a bar and screw-type device for adjustment purposes.
Figure 9:
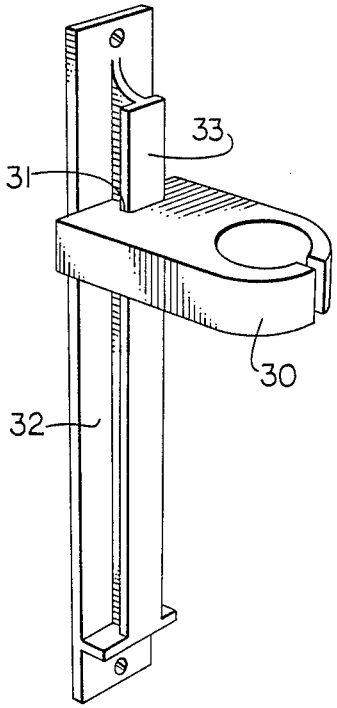
FIG. 9 is a view in perspective of a holder device with a rail for adjustment purposes.
Figure 10:
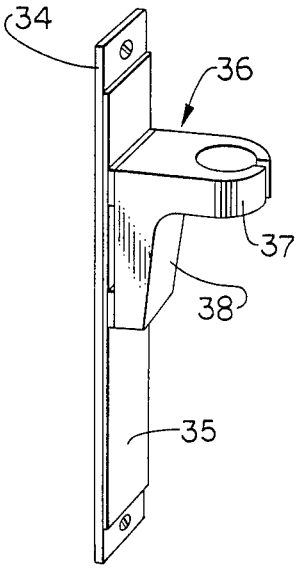
FIG. 10 is a view in perspective of still another holder device with Velcro attachment means.

There is shown in FIGS. 8–10 alternative attachment means and complimentary receiving means for allowing the holder member to be attached to its wall base. The wall mount base 23 of FIG. 8 has upper and lower body members 24 with a rod 25 set off a sufficient distance and extending along it's front section. The ends of the rod 25 are secured to bases 24 by conventional means. The attachment means found on the holder member 26 for use with the rod is a block shaped solid member 27 with a hole 28 extending from its top surface to its bottom surface and a thumb screw 29 in communication with the hole 28. In operation, the holder member 26 is positioned on the rod 29 and slid along said rod until the desired vertical position is attained. Tightening of the thumb screw 29 holds the holder member in this desired position.

The holder device of FIG. 9 has a block shaped holder member 30 with a recessed groove 31 extending the length of its back extremity acting as its attachment means. Wall mount base 32 has an elongated body with complimentary receiving means being a T-shaped rail 33 extending along its length. The rail 33 is dimensioned to accomodate the groove 31 of holder member 30. The holder member can freely slide along the rail, when held in a horizontal position, yet a binding force will hold it in place when not perfectly horizontal.

There is shown in FIG. 10 still another embodiment of the invention. As depicted there is shown a wall mount base comprised of an elongated plate 34 has a strip of Velcro 35 extending from the top portion of the base to the bottom portion. The holder device 36 has a main body 37 and a flange 38 extending therefrom. It additionally has Velcro positioned on its backside. The holder device can be positioned anywhere along the Velcro strip of the wall base mount.

Several other attachment means are capable of being used in this invention. Such means are not important to the invention herein. The means merely must be capable of allowing an adjustable positioning of the holder member to the wall base mount.

In operation, the wall mount base is initially permanently mounted on a wall within a room where a hair dryer is normally used, e.g. a bathroom. Initial vertical placement of the base on the wall need not be precise due to the nature of the invention. Next, the holder member is positioned so that its attachment means mate with one of the wall mount base's complimentary receiving means. The particular complimentary receiving means chosen, of course, depends on the height of the user relative to the proper hair dryer position. Once the vertical position of the holder member has been established, the handle of a hair dryer is placed in the open-sided receiving hole. Finally, the dryer is rotated to a position in accordance with the needs of the user and activated. The user is thus able to have his hair dried while his hands are free for styling purposes.

Specific embodiments of the present invention have been illustratred and described in detail. It should be understood however, that the invention is not limited thereto. Various changes can be made in the design of the holder member and the wall mount base as well the various attachment means without departing from the spirit and scope of the invention. In particular, it should be realized the described attachment means could be placed on the wall mount base and complimentary receiving means placed on the holder member while still enjoying the advantages as aforedescribed.

What is claimed is:

1. A wall mountable adjustable holder device for a hand held dryer allowing rotational and vertical movement of the hair dryer according to the needs of the user, said device comprising:

(a) a holder member having a receiving hole in one extremity with a slot extending vertically through the hole's depth, said receiving hole being dimensioned to receive a handle of the hair dryer and hold it securely in place while allowing the hair dryer to revolve freely according to the user's needs and said slot being sufficiently wide to accommodate an electric cord extending from the hair dryer, and further having a recess extending through another extremity, said recess having at least one rigid protrusion attachment means extending from a deepest part of the recess; and (b) a wall mount base capable of being permanently attached to a wall with complimentary receiving means on a front section to receive the rigid protrusion attachment means of the holder member, said complimentary receiving means being a series of keyhole shaped openings arranged vertically along the front section of the wall mount base, with each opening dimensioned to receive the rigid protrusion to securely hold the holder member in varying vertical positions, further wherein the depth of the wall mount base approximates the depth of the recess in the holder member extremity.

2. The device of claim 1 wherein the receiving hole is rounded.

3. The device of claim 2 wherein each rigid protrusion is capable of screwing into the holder member and has a knob at one end.

* * * * *